US012264687B2

(12) United States Patent
Reilly et al.

(10) Patent No.: US 12,264,687 B2
(45) Date of Patent: Apr. 1, 2025

(54) AIR AMPLIFIER

(71) Applicant: Dyson Technology Limited, Wiltshire (GB)

(72) Inventors: Philip Tennison Reilly, Gloucester (GB); Dale Marc Comley, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 0 days.

(21) Appl. No.: 18/278,632

(22) PCT Filed: Feb. 22, 2022

(86) PCT No.: PCT/GB2022/050492

§ 371 (c)(1),
(2) Date: Aug. 24, 2023

(87) PCT Pub. No.: WO2022/180389

PCT Pub. Date: Sep. 1, 2022

(65) Prior Publication Data

US 2024/0133397 A1 Apr. 25, 2024
US 2024/0229821 A9 Jul. 11, 2024

(30) Foreign Application Priority Data

Feb. 26, 2021 (GB) ..... 2102777

(51) Int. Cl.
*F04D 29/40* (2006.01)
*F04F 5/20* (2006.01)
*F04F 5/46* (2006.01)

(52) U.S. Cl.
CPC ..... *F04D 29/403* (2013.01); *F04F 5/20* (2013.01); *F04F 5/46* (2013.01)

(58) Field of Classification Search
CPC ... F04D 29/403; F04F 5/14; F04F 5/16; F04F 5/18; F04F 5/20; F04F 5/46–469
See application file for complete search history.

(56) References Cited

U.S. PATENT DOCUMENTS 2,583,374 A 1/1952 Hoffman
3,185,067 A 5/1965 Batchelor
(Continued)

FOREIGN PATENT DOCUMENTS

CN 101985949 A 3/2011
CN 201786776 U 4/2011
(Continued)

OTHER PUBLICATIONS

Examination Report received for GB Application No. 2102776.8, mailed on Jun. 20, 2023, 2 pages.
(Continued)

*Primary Examiner* — Christopher R Legendre
(74) *Attorney, Agent, or Firm* — Tucker Ellis LLP

(57) ABSTRACT

An air amplifier for directing airflow from a fan assembly, and a fan assembly including an air amplifier. The air amplifier includes an inlet for receiving airflow from a fan assembly, and an airflow cavity. The airflow cavity includes a first wall and a second wall that define an airflow passageway extending towards an exhaust outlet for emitting air. A divider body is provided within the passageway. The divider body divides the airflow passageway into a first exhaust passageway and a second exhaust passageway. The divider body tapers towards the exhaust outlet.

18 Claims, 7 Drawing Sheets

(56) References Cited

U.S. PATENT DOCUMENTS

| | | | | |
|---|---|---|---|---|
| 8,721,307 | B2 * | 5/2014 | Li | F04D 13/06 239/565 |
| 9,011,116 | B2 * | 4/2015 | Li | F04D 25/105 417/84 |
| 9,217,445 | B2 * | 12/2015 | Lo | F24F 8/158 |
| 10,094,392 | B2 * | 10/2018 | Poulton | F04D 25/08 |
| 11,486,413 | B2 * | 11/2022 | Jukes | F04D 25/08 |
| 11,680,581 | B2 * | 6/2023 | Jukes | F04D 29/403 415/182.1 |
| 2010/0226797 | A1 * | 9/2010 | Fitton | F24F 7/06 417/313 |
| 2013/0330215 | A1 | 12/2013 | Li | |
| 2018/0045203 | A1 | 2/2018 | Yang | |
| 2019/0170157 | A1 | 6/2019 | Mogridge et al. | |
| 2021/0270284 | A1 | 9/2021 | Jukes et al. | |

FOREIGN PATENT DOCUMENTS

| | | | | |
|---|---|---|---|---|
| CN | 201972972 | U | 9/2011 | |
| CN | 203670247 | U | 6/2014 | |
| CN | 103375440 | B | 4/2016 | |
| CN | 106762852 | A | 5/2017 | |
| CN | 106939893 | A | 7/2017 | |
| CN | 210599605 | U | 5/2020 | |
| DE | 1604111 | A1 | 4/1970 | |
| DE | 7217382 | U | 9/1975 | |
| DE | 102011001616 | A1 | 10/2012 | |
| EP | 2783116 | A2 | 10/2014 | |
| EP | 2990663 | A1 | 3/2016 | |
| GB | 2493672 | A | 2/2013 | |
| GB | 2568939 | A | 6/2019 | |
| GB | 2575066 | A | 1/2020 | |
| GB | 2616304 | A * | 9/2023 | F04D 19/002 |
| JP | 04-366330 | A | 12/1992 | |
| KR | 10-1469965 | B1 | 12/2014 | |
| WO | 2013/076454 | A2 | 5/2013 | |
| WO | WO-2020002879 | A1 * | 1/2020 | F04B 53/22 |
| WO | 2022/180384 | A1 | 9/2022 | |

OTHER PUBLICATIONS

International Search Report and Written Opinion received for PCT Patent Application No. PCT/GB2022/050486, mailed on Jun. 1, 2022, 10 pages.

International Search Report and Written Opinion received for PCT Patent Application No. PCT/GB2022/050492, mailed on May 2, 2022, 10 pages.

Search Report received for GB Application No. 2102776.8, mailed on Jul. 28, 2021, 1 page.

Search Report received for GB Application No. 2102777.6, mailed on July 28, 2021, 1 page.

* cited by examiner

AIR AMPLIFIER

CROSS-REFERENCE TO PRIOR APPLICATION

This application is a § 371 National Stage Application of PCT International Application No. PCT/GB2022/050492 filed Feb. 22, 2022, which claims the priority of United Kingdom Application No. 2102777.6, filed Feb. 26, 2021, each of which are herein incorporated by reference in their entirety.

FIELD OF INVENTION

The present disclosure relates to an air amplifier for directing airflow from a fan assembly, and a fan assembly comprising an air amplifier.

BACKGROUND

In the field of heating and cooling systems, 'bladeless' heating and/or cooling systems are known and are becoming a popular alternative to conventional bladed fans. Known 'bladeless' systems can be used in domestic settings and may also act as air purifiers and/or humidifiers/dehumidifiers. Whilst referred to as 'bladeless', bladeless heating and/or cooling systems typically include a base that houses a fan assembly powered by a motor. An air amplifier typically sits above the base and is configured to direct air away from the fan assembly and out of an exhaust outlet. The air amplifiers typically have an annular shape with an aerofoil inner surface. As air from the fan assembly is passed out of the exhaust outlet, air is drawn through the annulus over the aerofoil surface. This enables multiplication of airflow as air passes through the air amplifier.

It is desirable to improve airflow generated by heating/cooling systems whilst achieving high energy efficiency with low noise. This requires a low pressure system.

Known air amplifiers used for bladeless heating/cooling systems have a single slot exhaust outlet, typically with a width of about 3.5 mm. Increasing the width of the exhaust outlet slot may reduce air pressure at the outlet. However, increasing the slot width increases the risk of ingress of foreign objects into the slot. This may be a safety hazard and can lead to damage of the system. Furthermore, if the slot width is increased significantly, users may be able to see into the air amplifier, which is aesthetically undesirable.

It is known to use a divider to increase the number of distinct exhaust slots. Whilst this may help to reduce air pressure, this does not prevent ingress of foreign objects into the slot and towards the back of the air amplifier. Furthermore, a divider may not improve the aesthetics of the design, as there may still be a clear line of sight from the exhaust slot to the back of the air amplifier.

There is therefore a need to provide a safe and aesthetically pleasing low pressure air amplifier that enables improved airflow, high energy efficiency and low noise. The present invention seeks to address this problem.

SUMMARY OF INVENTION

According to a first aspect, the present disclosure provides an air amplifier for directing airflow from a fan assembly. The air amplifier comprises an inlet for receiving airflow from a fan assembly, and an airflow cavity. The airflow cavity comprises a first wall and a second wall that define an airflow passageway extending towards an exhaust outlet for emitting air. A divider body is provided within the passageway, the divider body dividing the airflow passageway into a first exhaust passageway and a second exhaust passageway. The divider body tapers towards the exhaust outlet.

The air amplifier may be configured to sit above a fan assembly provided in a base of a heating or cooling system. The air inlet may be provided at or towards the base of the air amplifier, and may be configured to direct air upwards from the fan assembly into the airflow cavity. The air inlet may direct air towards the back of the airflow cavity. The airflow cavity may have a smooth, curved back wall and the first wall and second wall of the airflow cavity may extend forward from the back wall towards the front of the air amplifier, forming the airflow passageway. The first wall and second walls that define the air flow passageway may be smooth, curved walls that reduce the pressure of air flowing towards the exhaust outlet. The airflow cavity as a whole may have a smooth internal geometry. The airflow cavity may widen towards the back wall, narrowing towards the airflow passageway and towards the front of the air amplifier. The exhaust outlet may be provided at the front of the airflow passageway. The exhaust outlet may comprise a slot, and the front edges of the airflow passageway may define the slot.

The air amplifier may have a ring shape that may be circular or a rounded oblong. The inner surface of the ring may comprise a smooth, aerofoil surface. As air is emitted from the exhaust outlet, air may be drawn in through the back of the air amplifier and pass over the aerofoil surface. This may lead to multiplication of airflow emitted from the front of the air amplifier.

The divider body may be provided towards the front of the airflow passageway. The divider body may be a solid body or a hollow body. The divider body may widen towards the rear of the air cavity to partially or completely block the line of sight from the exhaust outlet to the back wall of the airflow cavity. The divider body may be positioned centrally in the airflow passageway such that the first exhaust flow passageway and the second exhaust flow passageway have the same width. Advantageously, as the divider body tapers towards the exhaust outlet, a good air flow out of the exhaust outlet can be achieved, whilst reducing the risk of ingress of foreign objects into the air cavity and limiting the view into the air cavity.

The divider body may be wedge-shaped. The divider body may have a first side and a second side that taper to a point. The divider body may have a first side and a second side that taper towards a third side. The third side may be a straight side, or may be a curved side. Any of sides of the divider body may be surfaces of a solid divider body or walls of a hollow divider body. The divider body may be diamond shaped. The divider body may comprise a portion that tapers towards the exhaust outlet, and a portion that tapers away from the exhaust outlet. The divider body may comprise two sides that diverge from a point at the front of the exhaust outlet, and two further sides that converge away from the exhaust outlet, towards the rear of the air cavity.

The divider body may be a v-shaped wedge. The divider body may have at least two straight sides that taper to form the v-shape. The divider body may have a third straight side such that the divider body is triangular in shape.

The divider body may have at least one curved side. The divider body may have at least one concave side and/or at least one convex curved side.

The first wall and the second wall of the airflow passageway may taper towards the exhaust outlet, such that the airflow passageway narrows towards the exhaust outlet. A first side of the divider body may lie parallel to the first wall of the airflow passageway and a second side of the divider body may lie parallel to the second wall of the airflow cavity, such that the first and/or second exhaust passageways have an approximately constant width.

A first side of the divider body may taper with the first wall of the airflow passageway towards the exhaust outlet, such that the width of the first exhaust passageway narrows towards the exhaust outlet. Alternatively, or additionally, a second side of the divider body may taper with the second wall of the airflow passageway towards the exhaust outlet, such that the width of the second exhaust passageway narrows towards the exhaust outlet.

A front end of the divider body may protrude forward from a front edge of the exhaust outlet. This may help to prevent ingress of foreign objects into the front of the exhaust slot. Alternatively, the front end of the divider body may lie flush with a front edge of the exhaust outlet. The front end of the divider body may be a pointed tip, or may be a flat or curved wall, side or surface.

A lip may be provided at or towards a front edge of the first wall of the air passageway, wherein the lip extends towards the divider body, thereby partially inhibiting airflow from the first exhaust passageway. The first wall of the airflow passageway may be the outermost, which forms part of the outer surface of the ring and the second wall may be the inner wall, which forms part of the interior surface of the ring. The lip may change the direction of airflow in a similar way to a Gurney flap. The lip may therefore extend towards the centre of the air amplifier, directing air towards the centre of the air amplifier, thereby increasing inward momentum of airflow towards the centre of the air amplifier. The lip may also narrow the exhaust outlet, resulting in an increase in the airflow velocity of air emitted from the exhaust outlet. The lip does not extend across the entire of the width of the exhaust slot, such that air can still be emitted from the exhaust slot. The lip may be an extension of the first wall, or may be attached to the first wall.

At its widest point, the divider body may extend across between 30% and 70% of the airflow passageway. By spanning a significant portion of the width of the airflow passageway, the divider body may effectively reduce the risk of object ingress into the airflow cavity. At its widest point, the divider body may extend across at least 50% of the airflow passageway. At its narrowest point, the divider body may extend across up to 50% of the airflow passageway.

The airflow passageway may have a width of between 10 and 15 mm, preferably between 12 and 13 mm. The exhaust outlet may have a width of between 10 and 15 mm, preferably between 12 and 13 mm. This relatively large exhaust outlet enables a low pressure system, which is required to achieve low noise and high energy efficiency whilst still maintaining a high airflow. The first exhaust passageway may have a width of between 1.5 mm and 3.5 mm. The second exhaust passageway may have a width of between 1.5 mm and 3.5 mm. The divider may be positioned centrally in the airflow passageway, such that the first exhaust passageway and second exhaust passageway have the same width and/or the same width profile.

The divider body may be arranged to block any line of line of sight from the exhaust outlet to the back of the airflow cavity. The width of the divider body may increase towards the back of the airflow cavity, thereby blocking the line of sight. The walls of the airflow passageway may curve to aid blocking the line of sight from the exhaust outlet to the back of the airflow cavity. The airflow cavity may include a heating element. The divider body may be arranged to block any line of sight from the exhaust outlet to the heating element. This may improve the appearance of the air amplifier, and may also act as a safety feature, preventing or reducing the risk of ingress of foreign objects into the exhaust outlet or from reaching the back of the air cavity.

According to a second aspect, the present disclosure provides a fan assembly comprising an air amplifier. The air amplifier is an air amplifier including any of the features set out above. The fan assembly may be part of a heating and/or cooling system. The heating and/or cooling system may also function as an air amplifier. The fan assembly may be a fan assembly for use in a domestic setting.

It will of course be appreciated that features described in relation to one aspect of the present invention may be incorporated into other aspects of the present invention.

DESCRIPTION OF THE DRAWINGS

Embodiments of the present invention will now be described by way of example only with reference to the accompanying drawings of which:

FIG. 2(*b*) is a cross section of a part of the air amplifier taken along the line A-A shown in FIG. 2(*a*) showing a diamond-shaped divider body;

FIG. 3(*b*) is a cross section taken along the line A-A shown in FIG. 4(*a*), showing a teardrop shaped divider body;

FIG. 5(*b*) is a cross section taken along the line A-A shown in FIG. 6(*a*) showing an angled lip;

DETAILED DESCRIPTION

Figure 1:
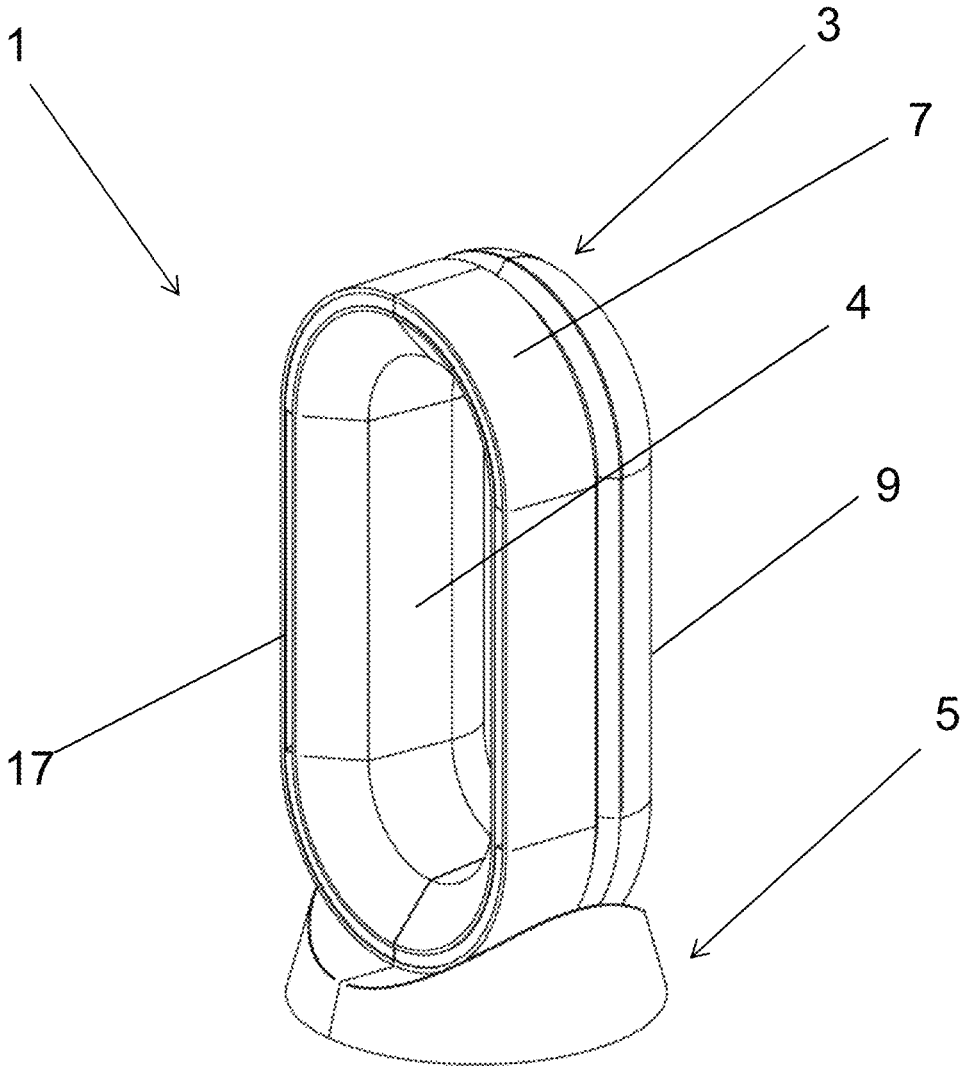
FIG. 1 is a perspective view of a fan assembly comprising an air amplifier according to a first embodiment of the present disclosure.

FIG. 1 shows a perspective view of a fan assembly 1 comprising an air amplifier 3 that sits above a base, 5 according to a first embodiment of the present disclosure. The air amplifier 3 has a rounded oblong ring shape, and the inner surface of the ring comprises a smooth, aerofoil surface 4. The base 5 houses a fan impeller (not shown) that is powered by a motor (not shown). An air inlet (not shown) is provided at the bottom of the air amplifier 3 and, when the fan assembly 1 is in use, the air inlet receives air from the fan impeller. Air from the base 5 is directed upwards via the air inlet towards the back of the airflow cavity 7.

Figure 2A:
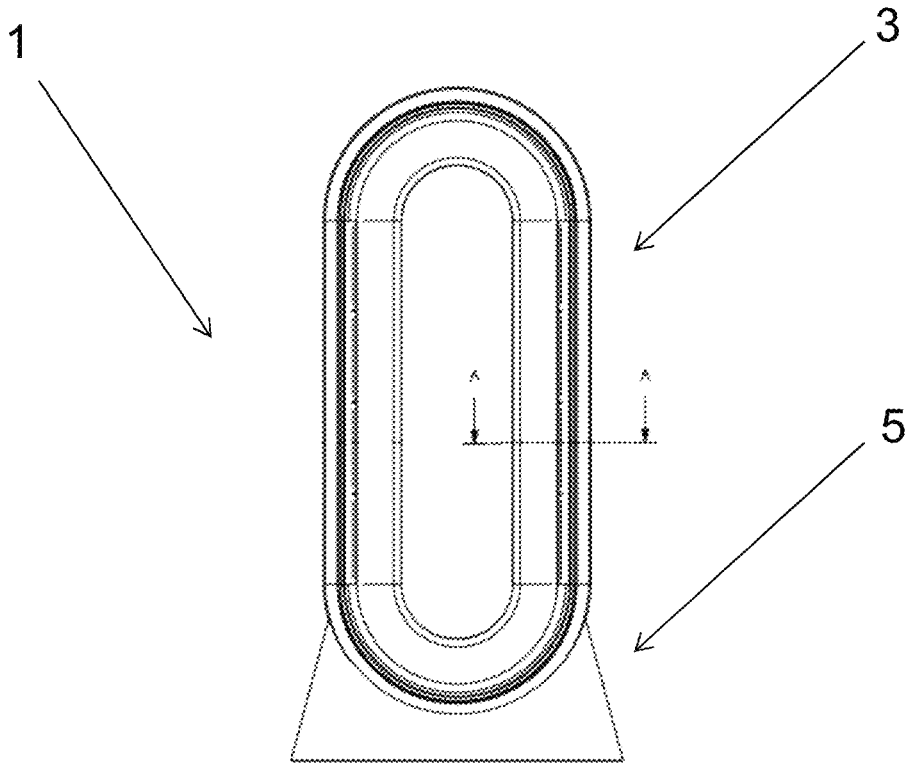
FIG. 2(*a*) is a front view of the fan assembly of FIG. 1.
Figure 2B:
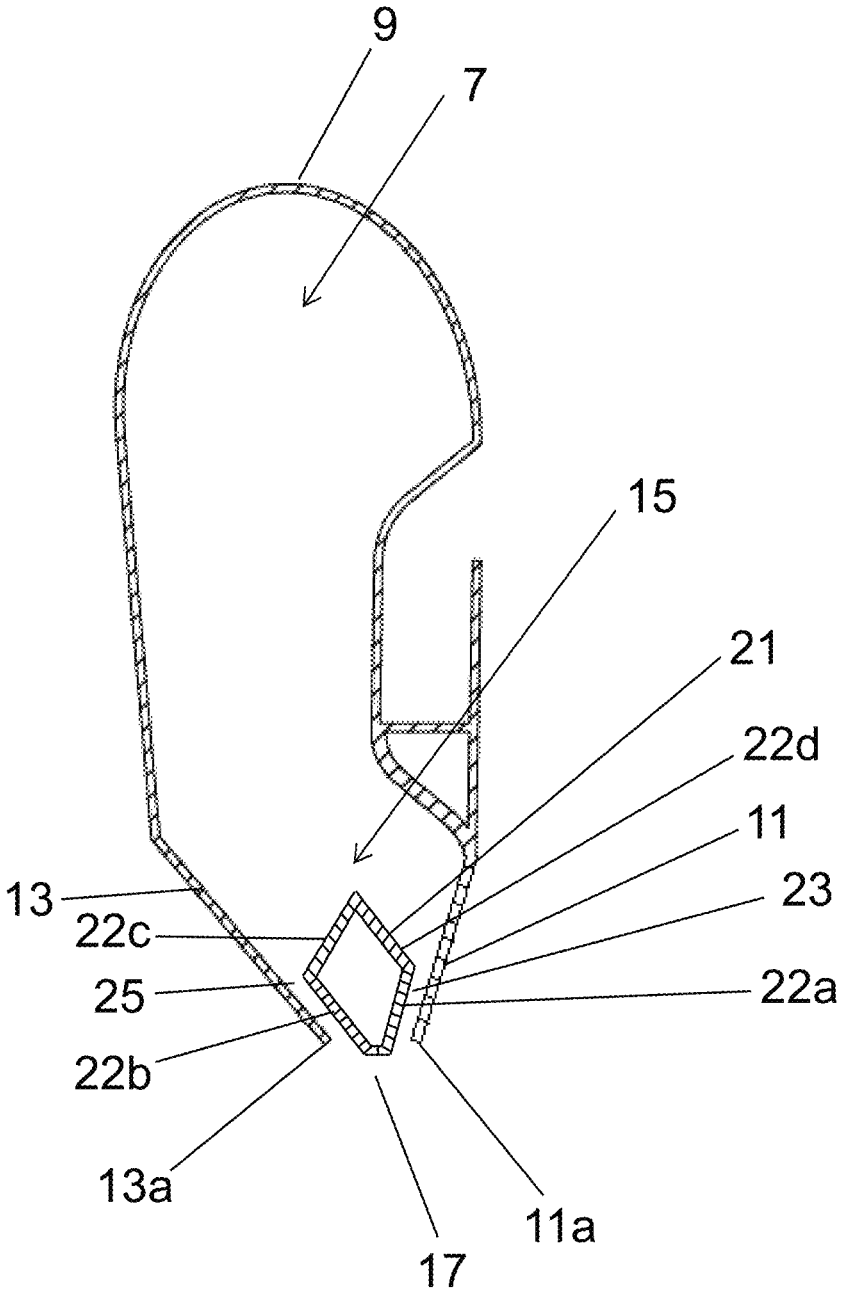

FIG. 2(*a*) shows a front view of the fan assembly 1 shown in FIG. 1, and FIG. 2(*b*) shows a cross section taken through the air amplifier 3 along the line A-A. The airflow cavity 7 has a smooth curved back wall 9 designed to reduce air pressure within the airflow cavity 7. A first wall 11 and second wall 13 (shown in FIG. 2(*b*) and FIG. 3) of the air amplifier extend forward towards the front of the air amplifier 3 forming an airflow passageway 15. An exhaust outlet 17 is provided at the front of the airflow passageway 15. The exhaust outlet is a slot defined by the front edges 11*a*, 13*a* of the first wall 11 and the second wall 13. A diamond-shaped divider body 21 is provided within the airflow passageway 15 and divides the airflow passageway into a first exhaust outlet 23 and a second exhaust outlet 25.

In use, air flows from the back of the airflow cavity 7 forward along the airflow passageway 15 towards the exhaust outlet 17 and is emitted from the from the exhaust slot 17. As air is emitted from the exhaust slot 17, air is drawn through the back of the air amplifier 3 and passes over the aerofoil surface 4 of the ring. The divider body 21 is provided towards the front of the airflow passageway 15 and divides the airflow passageway into a first exhaust passageway 23 and a second exhaust passageway 25. The divider body is a hollow diamond-shaped body comprising four sides 22*a*, 22*b*, 22*c*, 22*d*. A first side 22*a* and second side 22*b* of the divider body 21 taper to a point that protrudes slightly forward of the exhaust slot 17. The first side 22*a* and second side 22*b* of the divider body widen towards the rear of the airflow cavity 7. The divider body 21 thereby blocks the line of sight from the exhaust slot 17 to the back wall 9 of the airflow cavity 7, and helps to prevent ingress of objects into the exhaust slot 17. The first side 22*a* and second side 22*b* of the divider body 21 are substantially parallel to the first wall 11 and second wall 13 of the airflow passageway 15 respectively, and the divider body 21 is positioned centrally within the airflow passageway 15 such that the first exhaust passageway 23 and second exhaust passageway 25 are equal in width and have a constant width. A third side 22*c* and fourth side 22*d* of the divider body 21 taper towards the rear of the airflow passageway 15, thereby creating the diamond shape.

Figures 3A, 3B:
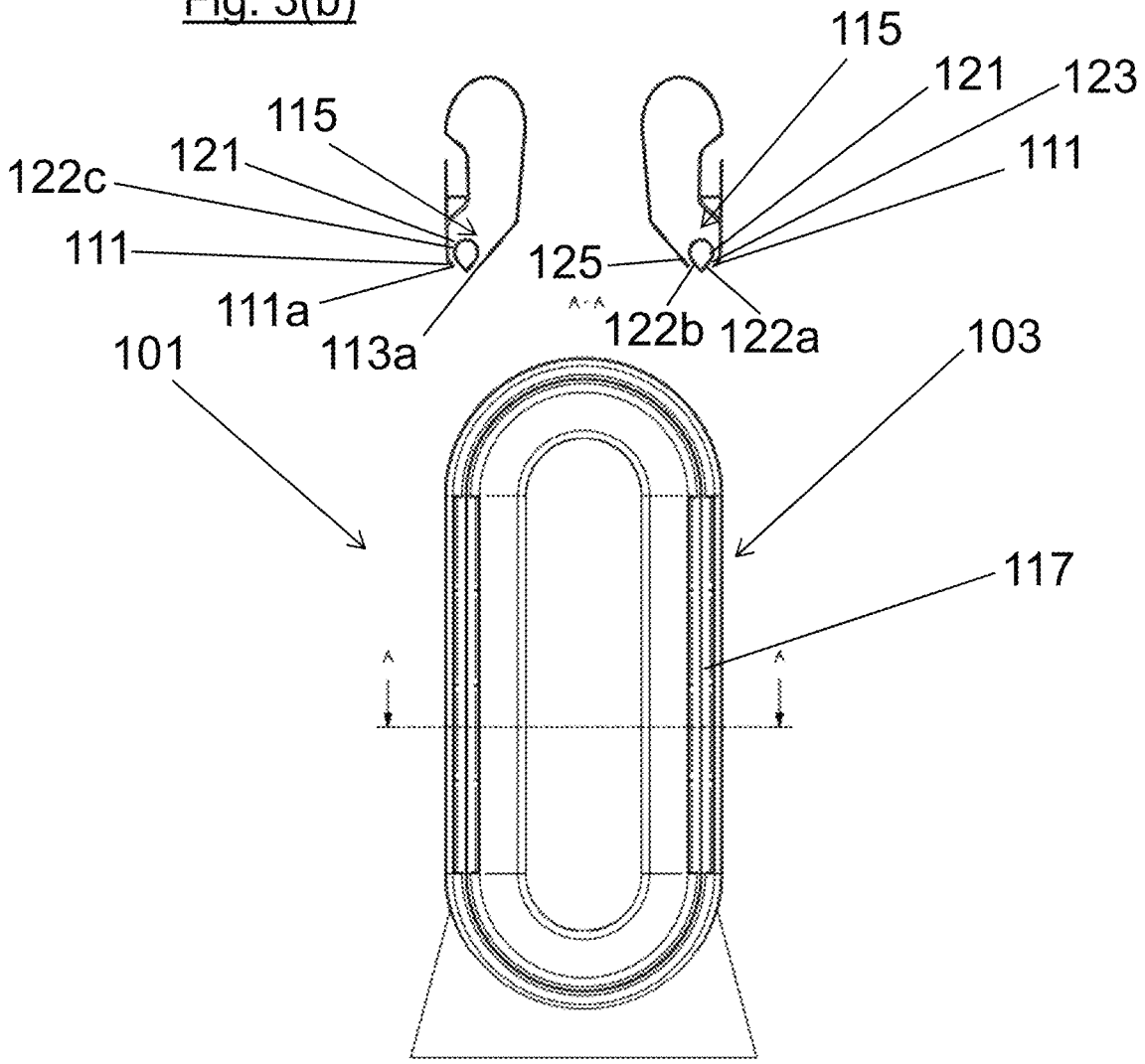
FIG. 3(*a*) is a front view of a fan assembly comprising an air amplifier according to a second embodiment of the present disclosure.
Figure 4:
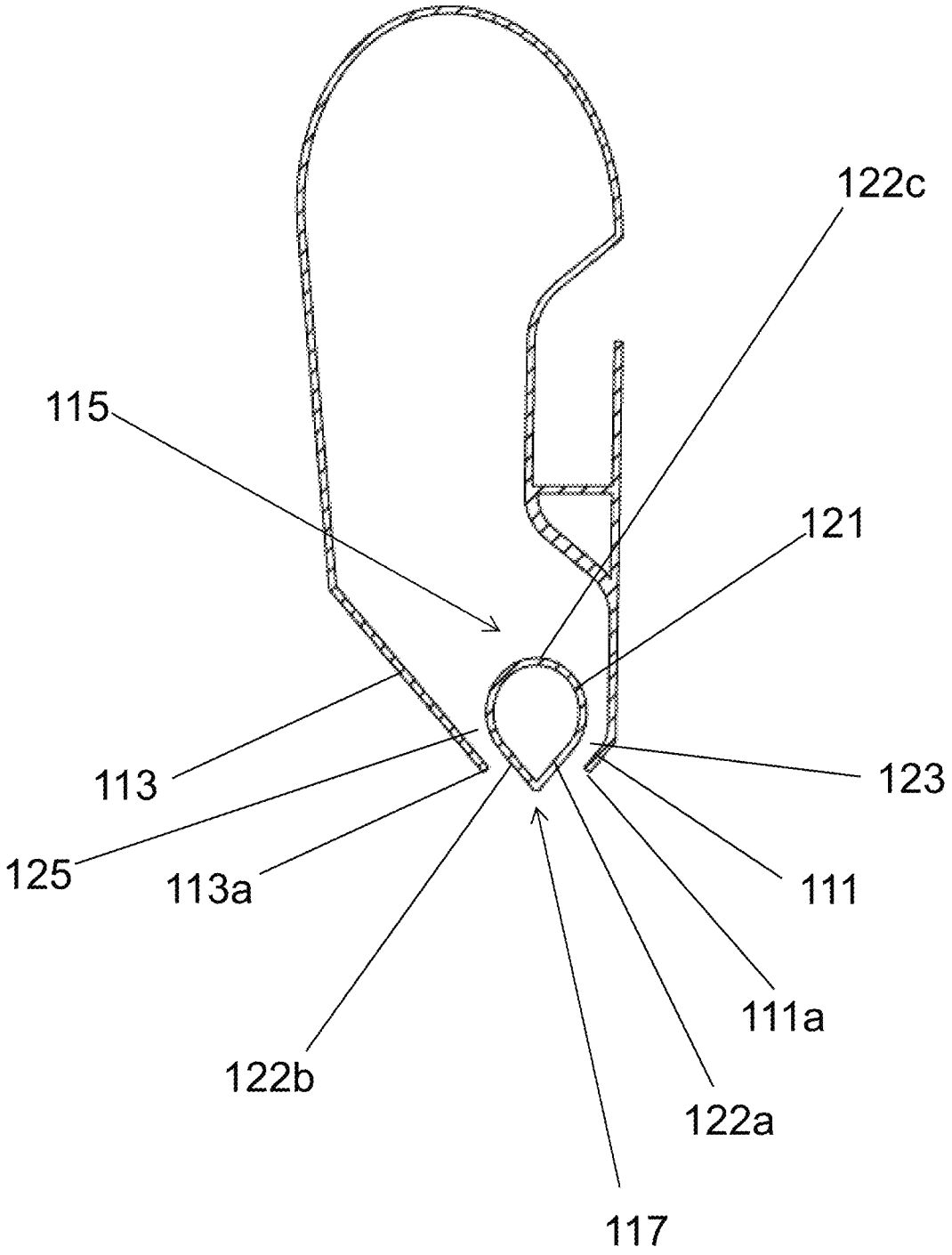
FIG. 4 is a close-up view of a portion of the cross section shown in FIG. 4(*b*) showing a teardrop shaped divider body.

A fan assembly 101 according to a second embodiment of the present disclosure is shown in FIGS. 3(*a*), 3(*b*) and 4. In this embodiment, the divider body 121 provided in the airflow passageway 115 is a teardrop-shaped hollow body. The divider body 121 comprises a first wall 122*a* and a second side 122*b* that taper to point protruding forwards of the exhaust slot 117, and a third curved side 122*c* that forms the back of the divider body 121. The first wall of the airflow passageway 111 and the second wall 113 of the airflow passageway 115 taper towards the front of the air amplifier 103 and the front edge 111*a* of the first wall and the front edge of the second wall 113*a* define the exhaust slot 117. The first wall 112*a* and second wall 112*b* of the divider body 121 lie parallel to the first wall and 111 and the second wall 113 of the airflow passageway and the divider body 121 is provided centrally in the airflow passageway such that the first exhaust passageway 123 and the second exhaust passageway 125 are equal in width and have a constant width.

Figures 5A, 5B:
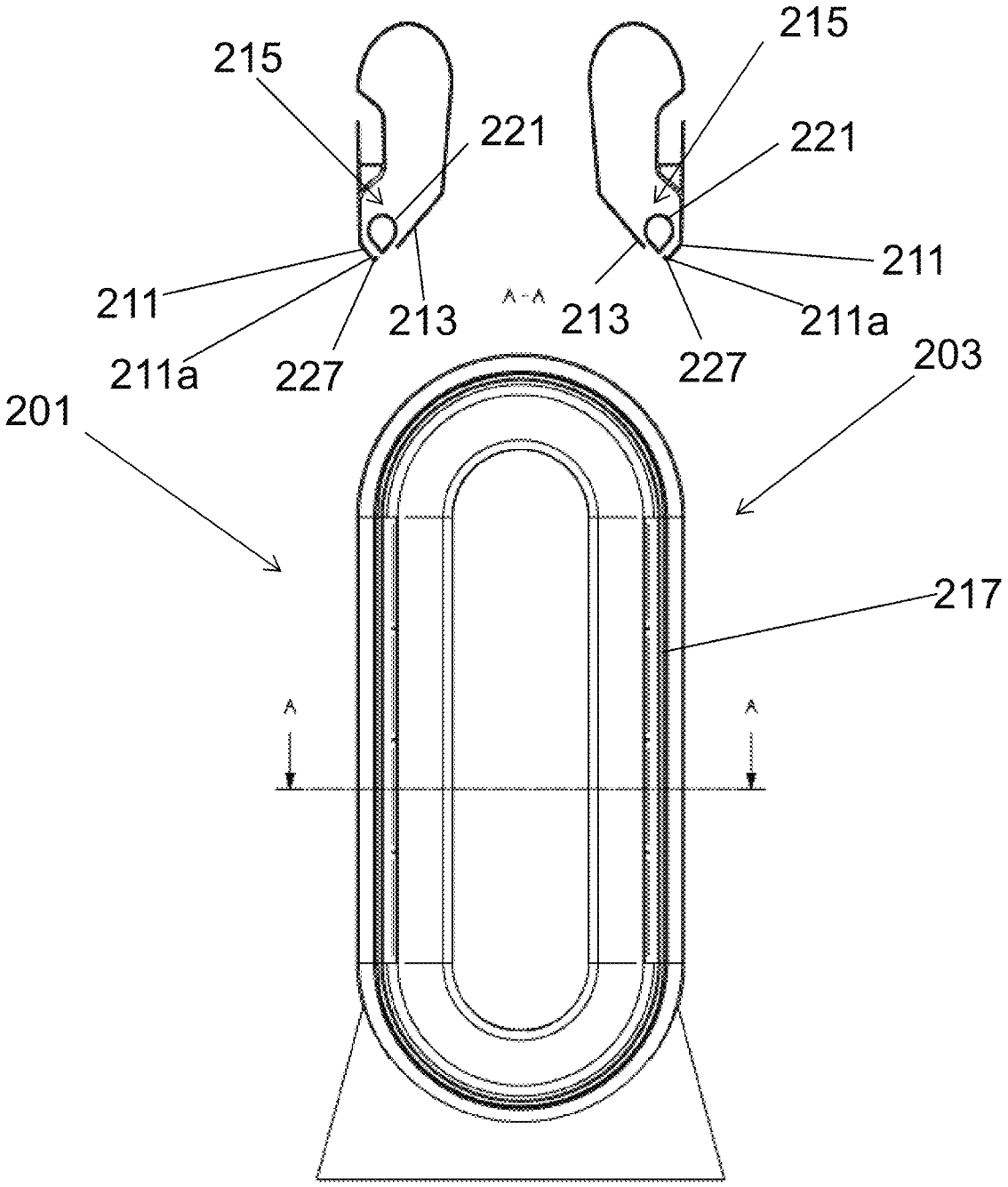
FIG. 5(*a*) is a front view of a fan assembly comprising an air amplifier according to a third embodiment of the present disclosure.
Figure 6:
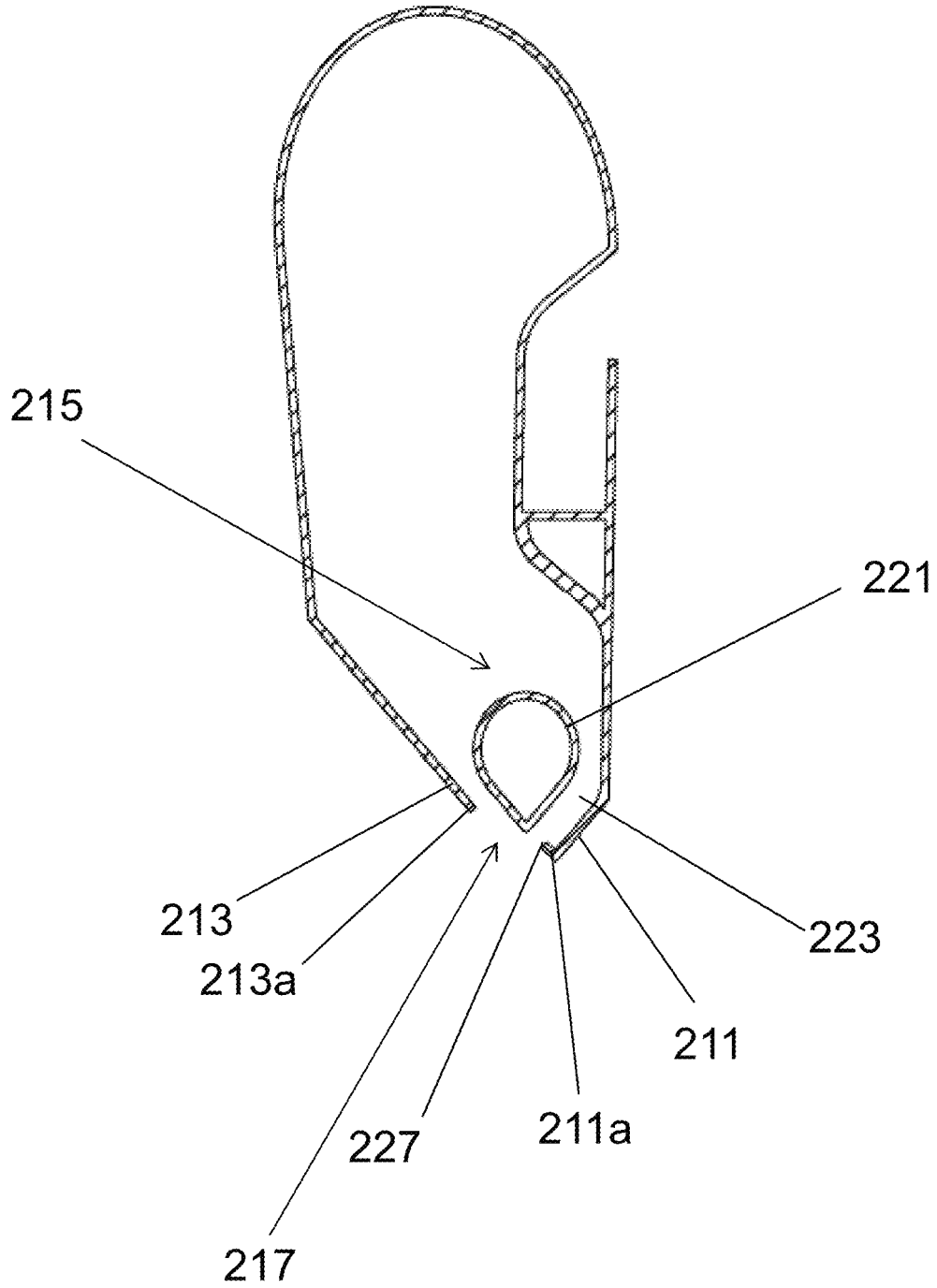
FIG. 6 is a close-up view of a portion of the cross section shown in FIG. 5(*b*) showing an angled lip.

A fan assembly 201 according to a third embodiment of the present disclosure is shown in FIGS. 5(*a*), 5(*b*) and 6. In this embodiment, the divider body 221 provided in the airflow passageway 215 is teardrop-shaped hollow body, and a lip 227 is provided on the front edge 211*a* of the first wall 211 of the airflow passageway. The lip 227 extends perpendicularly to the first wall 211 of the airflow passageway towards the front edge 213*a* of the second wall 213, thereby partially blocking the first exhaust passageway 223. The lip 227 changes the direction of airflow in a similar manner to a Gurney flap. The lip 227 narrows the exhaust outlet 217 by partially blocking the first exhaust passageway 223, and increases inward momentum of air flowing from the first exhaust passageway out of the exhaust slot 217. The lip 227 creates a sharp 90 degree wall angle within the airflow passageway 215, which leads to a significant increase in inward momentum in a small space compared to smooth, curved internal walls, thereby improving the performance of the air amplifier 203.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

In some embodiments, the divider body is a solid body rather than a hollow body.

In some embodiments, the first wall and second wall of the airflow passageway taper relative to the sides or walls of the divider body such that the first and second exhaust flow passageways narrow towards the exhaust outlet.

In some embodiments, the front of the divider body lies flush with the front of the exhaust outlet.

In some embodiments, the air amplifier is part of a cooling system and/or a heating system. In some embodiments the heating and/or cooling system is also an air purifier. In some embodiments a heating element is provided at the rear of the airflow cavity and the divider body blocks the line of sight from the exhaust outlet to the heating element.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. An air amplifier for directing airflow from a fan assembly, the air amplifier comprising:

an inlet for receiving airflow from the fan assembly; and an airflow cavity, wherein the airflow cavity is defined by a first wall and a second wall that define an airflow passageway extending towards an exhaust outlet for emitting air;

and wherein a divider body is provided within the airflow passageway, the divider body dividing the airflow passageway into a first exhaust passageway and a second exhaust passageway, wherein the divider body tapers towards the exhaust outlet, and wherein the first exhaust passageway and the second exhaust passageway are equal in width and have a constant width.

2. The air amplifier according to claim 1, wherein the divider body is wedge-shaped.

3. The air amplifier according to claim 1, wherein the divider body is diamond-shaped.

4. The air amplifier according to claim 1, wherein the divider body is a v-shaped wedge.

5. The air amplifier according to claim 1, wherein the divider body has at least one curved side.

6. The air amplifier according to claim 1, wherein the first wall and the second wall of the airflow passageway converge towards the exhaust outlet.

7. The air amplifier according to claim 1, wherein a first side of the divider body lies parallel to the first wall of the airflow cavity and a second side of the divider body lies parallel to the second wall of the airflow cavity.

8. The air amplifier according to claim 1, wherein a first side of the divider body converges with the first wall of the airflow passageway towards the exhaust outlet, and/or a second side of the divider body converges with the second wall of the airflow passageway towards the exhaust outlet.

9. The air amplifier according to claim 1, wherein a front end of the divider body protrudes forward from a front edge of the exhaust outlet.

10. The air amplifier according to claim 1, wherein a front end of the divider body lies flush with a front edge of the exhaust outlet.

11. The air amplifier according to claim 1, wherein a lip is provided at or towards a front edge of the first wall of the air passageway, wherein the lip extends towards the divider body, thereby partially inhibiting airflow from the first exhaust passageway.

12. The air amplifier according to claim 1, wherein, at its widest point, the divider body extends across at least 50% of the width of the airflow passageway.

13. The air amplifier according to claim 1, wherein the width of the first exhaust passageway is between 1.5 mm and 3.5 mm, and wherein the width of the second exhaust passageway is between 1.5 mm and 3.5 mm.

14. The air amplifier according to claim 1, wherein the divider body is sized and shaped, and positioned within the airflow cavity such that it obstructs a direct line of sight from the exhaust outlet to a backmost wall of the airflow cavity, the backmost wall being furthest from the exhaust outlet.

15. The air amplifier according to claim 1, wherein the airflow cavity includes a heating element.

16. The air amplifier according to claim 15, wherein the divider body is positioned within the airflow cavity such that it obstructs a direct line of sight from any point on the exhaust outlet to any point on the heating element located at a rear of the airflow cavity.

17. The air amplifier according to claim 15, wherein the divider body is sized and shaped, and positioned within the airflow cavity such that the divider body prevents foreign objects greater than the width of each of the first and second exhaust passageways from entering the airflow cavity through the exhaust outlet.

18. A fan assembly, the fan assembly comprising the air amplifier as claimed in claim 1.

* * * * *